United States Patent [19]

Gavignet et al.

[11] 4,452,076

[45] Jun. 5, 1984

[54] WELL LOGGING TOOL

[75] Inventors: Alain H. Gavignet; Walter E. Cubberly, Jr., both of Houston, Tex.

[73] Assignee: Schlumberger Technology Corporation, Houston, Tex.

[21] Appl. No.: 390,377

[22] Filed: Jun. 21, 1982

[51] Int. Cl.[3] ..... E21B 21/08

[52] U.S. Cl. ..... 73/155; 166/133; 166/188

[58] Field of Search ..... 73/155; 166/183, 133, 166/188

[56] References Cited

U.S. PATENT DOCUMENTS

| | | | |
|---|---|---|---|
| 2,649,710 | 8/1953 | Dale | 73/155 |
| 2,654,433 | 10/1953 | Piety | 73/155 |
| 2,701,615 | 2/1955 | Riordan, Jr. et al. | 166/188 |
| 2,706,406 | 4/1955 | Vincent et al. | 73/155 |
| 2,962,895 | 12/1960 | Rumble | 73/155 |
| 3,066,739 | 12/1962 | Saurenman et al. | 166/188 |
| 3,113,455 | 12/1963 | Sloan et al. | 73/155 |
| 3,176,511 | 4/1965 | Widmyer | 73/155 |
| 3,379,059 | 4/1968 | Wiley | 73/155 |
| 3,431,974 | 3/1969 | Buck et al. | 73/155 |
| 3,592,056 | 7/1971 | Bernaix | 73/194 |

*Primary Examiner*—Howard A. Birmiel

[57] ABSTRACT

A well logging tool, for use within a well borehole having a flowing fluid therein, has a selective bypass means for directing a portion of the flowing fluid away from the housing of the well logging tool upon the flowing fluid exerting a predetermined pressure force upon a packer, whereby damage to the packer from increased pressure forces is minimized and flow characteristics of a fluid flowing at widely varying flow rates may be measured.

23 Claims, 8 Drawing Figures

Fig. 3A
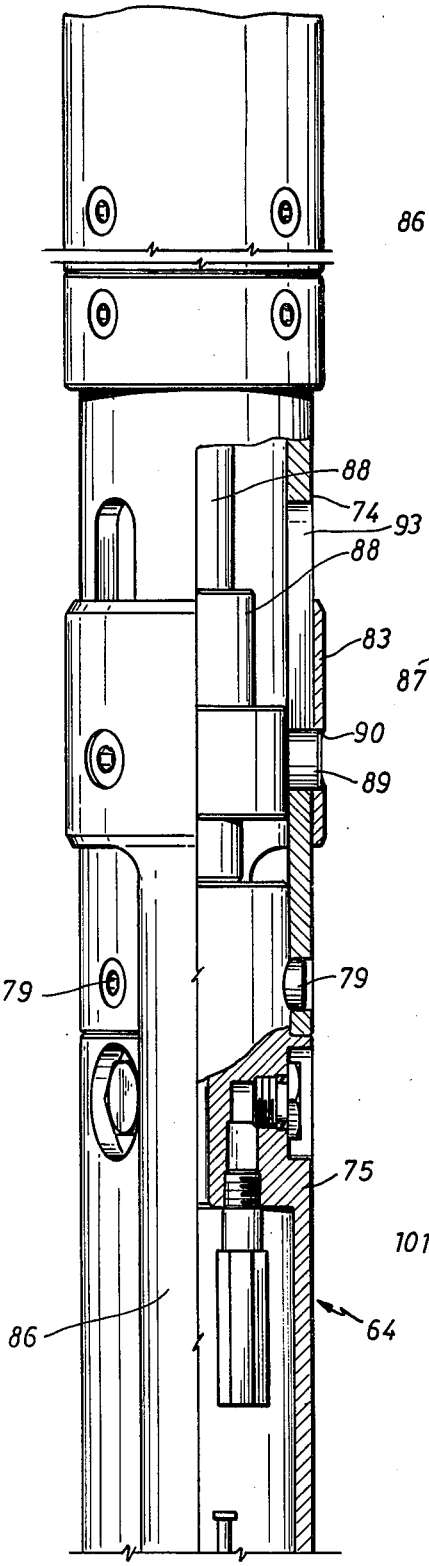
Fig. 3B
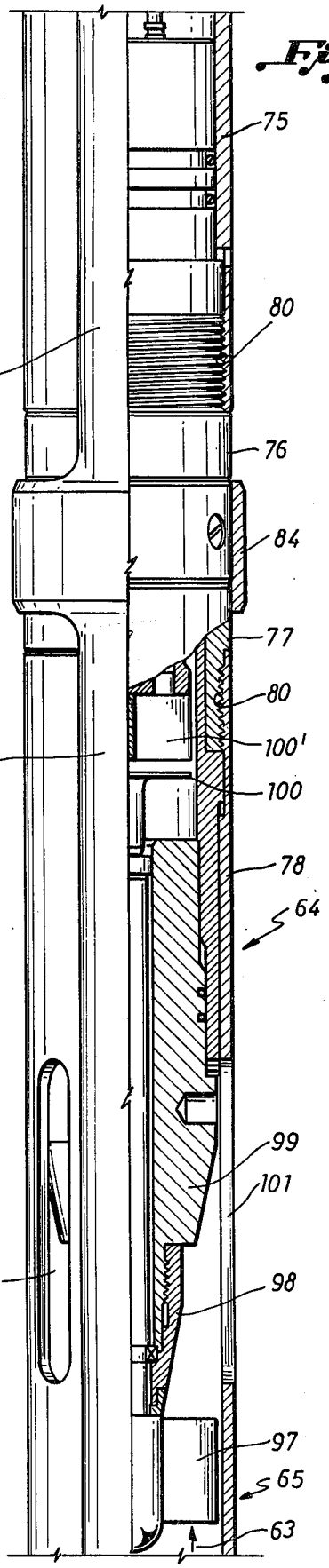
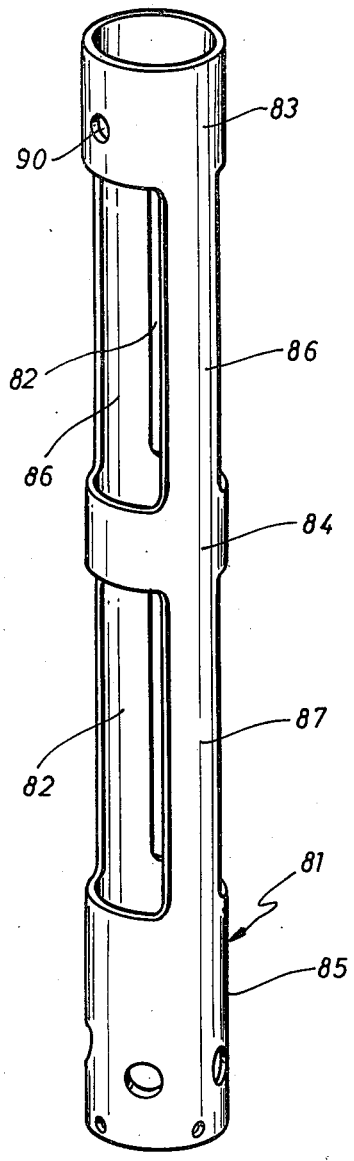
Fig. 4

87
78
64
105
102
103
85
119
118
120'
62
120
114
117
133
133
67
135
112
107
116
110
134
113
104
116
106
109
111
108
66
5
5
63
63
63
63
102
113
127
115
126
129
128
130
121
125
132

113
127
126
115
118
129
130
125'
125
132
102
121
131
130
124
122
123

136
106
110
113
107
107
62
112
108
102
109

WELL LOGGING TOOL

FIELD OF THE INVENTION

The invention relates to: a well logging tool, for use within a well borehole having a flowing fluid therein, which includes a selective bypass means whereby fluid characteristics of fluids flowing at widely varying flow rates may be measured; and a method for measuring fluid characteristics of fluids flowing at varying flow rates within a well borehole.

DESCRIPTION OF THE PRIOR ART

Packer flowmeters are a widely used well-logging tool for obtaining reliable indications of the rate of fluid flow through a well bore, normally being the well casing. Packer flowmeters generally include a passageway having an inlet orifice to the interior of the tool and an outlet orifice to the exterior of the tool, and a spinner section which measures the rate of fluid flow through the passageway. The packer portion of the packer flowmeter closes off the annulus between the outside diameter of the tool and the well bore, or well casing. The packer portion of the packer flowmeter may be an inflated cloth bag, a metal basket type device, or other suitable, similar device.

Examples of such packer flowmeters are disclosed in U.S. Pat. Nos.: 2,649,710, issued to Dale; 2,706,406, issued to Vincent et al; and 3,176,511, issued to Widmyer. The Dale patent discloses the use of a packer device comprising a plurality of spaced fingers having thin, flexible, metallic vanes mounted to the fingers, whereby the vanes form a downwardly flared truncated funnel servng to direct liquid flow into the tool. The Vincent et al patent discloses the use of a packer basket supported by bow springs. The Widmyer patent discloses the use of a collapsible shell packer in connection with the flowmeter.

The foregoing prior art packer flowmeters operate satisfactorily when the well is flowing at a low flow rate. However, when higher flow rates are encountered in the well bore, the greatly restricted flow area caused by the packer generates a large pressure drop across the packer. The increased pressure drop, or increased pressure force, acts upwardly against the packer and can damage the packer. Under some circumstances, the icreased pressure forces can force the entire packer flowmeter upwardly through the well bore, or well casing, which is highly undesirable.

In producing oil and gas wells, where there are numerous perforations in the well casing, the flow rate of the flowing fluid varies along the length of the well casing. It is very common in such wells to have a low flow rate in the lower part of the well, but as the well logging tool is moved upwardly towards the upper end of the perforated zone of the well casing, the flow rate increases due to the increasing number of perforations below the tool. The foregoing described prior art devices may not be capable of being used to measure the increased flow rate which can occur at the upper end of the producing zone of the well casing without encountering the previously described problems resulting from higher flow rates. Thus, it becomes necessary to use one type of packer flowmeter well logging tool in the lower end of the producing zone of the well bore, which tool must be removed from the well bore and substituted with another type of device to measure the increased fluid flow at the upper end of the producing zone of the well bore.

Accordingly, prior to the development of the present invention, there has been neither a method for measuring fluid characteristics of a fluid flowing at varying flow rates within a well borehole, nor a well logging tool for use within a well borehole having a flowing fluid therein, which is not subject to damage from increased pressure forces acting upon the packer and can be utilized to measure fluid characteristics of a fluid flowing at widely varying flow rates within the same well bore. Therefore, the art has sought a method and well logging tool, for use within a well borehole having a flowing fluid therein, which minimizes damage to the packer from increased pressure forces, and may be used throughout the same well borehole to measure fluid characteristics of a fluid flowing at widely varying flow rates.

SUMMARY OF THE INVENTION

In accordance with the invention the foregoing has been achieved through the present well logging tool for use within a well borehole having a flowing fluid therein. The present invention includes: a housing; means for measuring a fluid characteristic of the flowing fluid, the means for measuring being disposed within the housing; means for sealing the well borehole and for directing the flowing fluid into the housing; and selective bypass means for directing a portion of the flowing fluid away from the housing upon the flowing fluid exerting a predetermined pressure force upon the sealing and directing means, whereby damage to the sealing and directing means from increased pressure forces is minimized and fluid characteristics of a fluid flowing at widely varying flow rates may be measured. A feature of the present invention resides in the fact that the means for sealing and directing may comprise a plurality of flexible vanes having upper, lower, and side edges, with the side edges of adjacent vanes being disposed in an overlapping relationship; the lower edges of the vanes being disposed adjacent the interior surface of the well borehole; the upper edges of the vanes being disposed in a first position in an abutting relationship with the housing when the pressure force is below the predetermined force; and at least one of the upper edges of the vanes being disposed in a second position spaced from the housing when the pressure force exceeds the predetermined force.

Another feature of the present invention is that the selective bypass means may comprise a plurality of elongate spring members each having first and second ends, the first ends being operatively associated with the housing; and the vanes being flexibly attached to the elongate spring members. A further feature of the present invention is that each of the second ends of the elongate spring members may be mounted to a bottom nose assembly for relative longitudinal movement therebetween; and the flexible vanes are flexibly attached to the elongate spring members intermediate their first and second ends. Another feature of the present invention is that the means for measuring a fluid characteristic may comprise a flowmeter.

An additional feature of the present invention is that the selective bypass means may further include a plurality of elongate booster spring members which are operatively associated with the housing and overlie the elongate spring members. The present invention may also include a plurality of back-up spring members attached to the flexible vanes, the vanes being disposed between the elongate and back-up spring members. A further feature of the present invention is that the housing may include a mandrel secured thereto; the mandrel having at least one passageway in fluid transmitting relationship between the sealing and directing means, and the means for measuring; the first ends of the elongate spring members being slideably mounted with respect to the mandrel; and a first portion of the bottom nose assembly being slideably mounted to the mandrel.

The present invention also includes a method for measuring a fluid characteristic of a fluid flowing at varying flow rates within a well bore. The method includes the steps of: moving a housing, having a means for measuring a fluid characteristic within the housing, through the well bore to a first location; sealing the well bore proximate the first location and directing the flowing fluid into the housing by utilizing a sealing and directing means; and directing a portion of the flowing fluid away from the housing upon the flowing fluid exerting a predetermined pressure force upon the sealing and directing means, whereby damage to the sealing and directing means from increased pressure forces is minimized and fluid characteristics of a fluid flowing at varying flow rates may be measured.

The well logging tool, for use within a well borehole having a flowing fluid therein, and method for measuring fluid characteristics of a fluid flowing at varying flow rates within a well borehole of the present invention, when compared with previously proposed prior art packer flowmeters and methods have the advantages of minimizing damage to the packer from increased pressure forces in the well borehole, and may be used throughout the same well borehole to measure fluid characteristics of a fluid flowing at widely varying flow rates to thus greatly increase the working range of the well logging tool.

BRIEF DESCRIPTION OF THE DRAWINGS

In the drawings:

FIGS. 3A–3D are partial cross-sectional views along the longitudinal axis of the well logging tool in accordance with the present invention;

FIG. 4 is a plan view of a component of the well logging tool in accordance with the present invention.

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
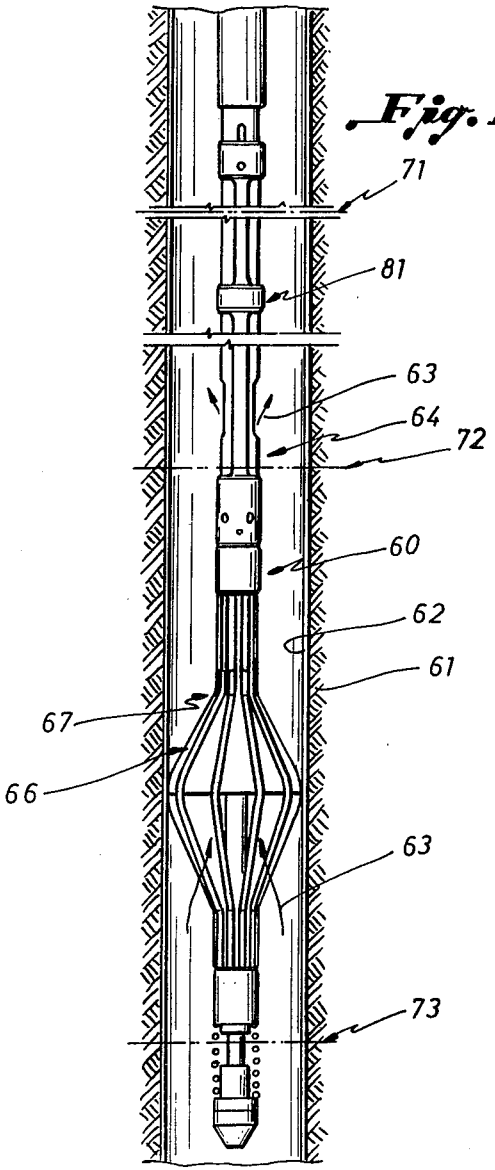
FIG. 1 is a partial cross-sectional view along the longitudinal axis of a well bore schematically illustrating the well logging tool in accordance with the present invention.

In FIG. 1, a well logging tool 60 in accordance with the present invention is shown disposed within well bore 61 which has a conventional well casing 62 disposed on the interior surface of well bore 61. Flowing fluid, such as hydrocarbons, is shown by arrows 63, which flowing fluid passes through the well logging tool 60 as will be hereinafter described. Well logging tool 60 generally comprises: a housing 64; a means for measuring 65 (not shown in FIG. 1) a fluid characteristic of the flowing fluid 63, which measuring means 65 is disposed within housing 64; means for sealing 66 the well casing 62 and for directing the flowing fluid 63 into housing 64; and selective bypass means 67 for directing a portion of the flowing fluid 63 away from the housing 64 upon the flowing fluid 63 exerting a predetermined pressure force upon the sealing and directing means 66, whereby damage to the sealing and directing means 66 from increased pressure forces is minimized and fluid characteristics of a fluid flowing at widely varying flow rates may be measured. In the preferred embodiment, the means for measuring may comprise a flowmeter, to be hereinafter described, whereby the fluid characteristic to be measured is the flow rate of the fluid 63. As is conventional in the art, well casing 62 has a plurality of perforations (not shown) disposed about its circumference and along its length, through which flowing fluid 63, such as hydrocarbons, pass from well bore 61 through the perforations into well casing 62.

Figure 2:
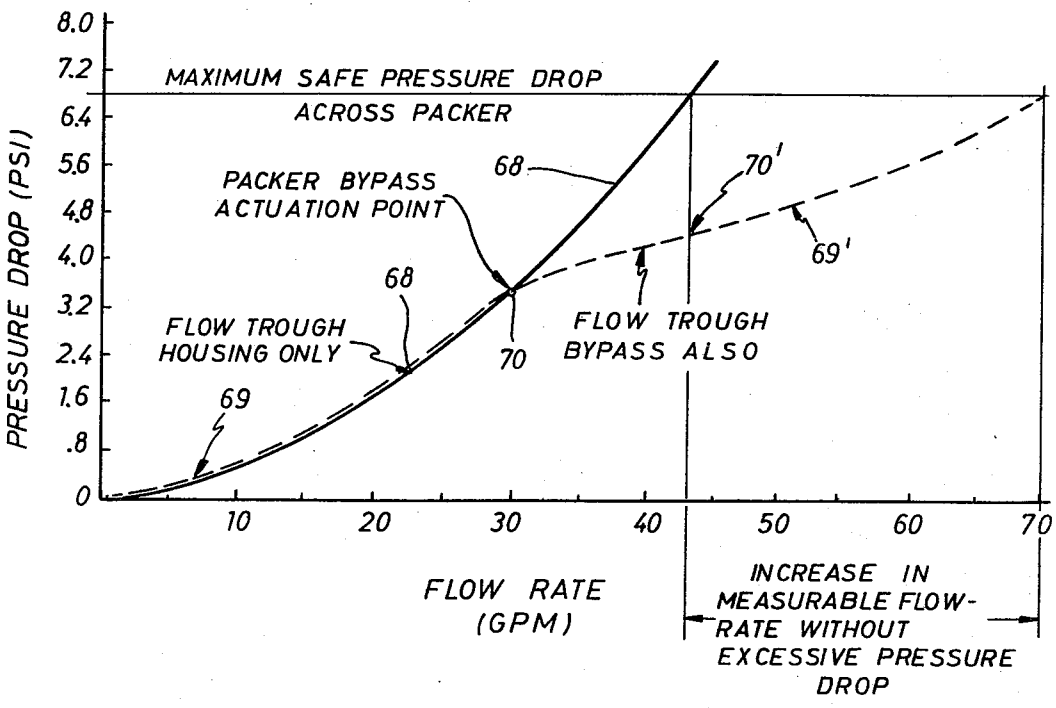
FIG. 2 is a chart illustrating the relationship between pressure drop across a packer compared with the flow rate of the flowing fluid.

Turning now to FIG. 2, the general operation of the well logging tool 60 of the present invention and prior art packer flowmeters will be described. In FIG. 2, the pressure drop, or pressure forces, across a packer (or the means for sealing and directing 66 the flowing fluid 63 into the housing 64) is plotted with respect to the flow rate of the flowing fluid 63. It should be noted that the numbers used on the horizontal and vertical axes of the chart of FIG. 2 are for illustrative purposes only. Curve 68 (solid line) is illustrative of prior art devices and illustrates that as the flow rate of the flowing fluid 63 increases, the pressure drop, or pressure force acting upon the packer also increases. With prior art packer flowmeters and increased pressure forces acting upon the packer, the previously described problems can occur.

Still with reference to FIG. 2, it is seen that an additional curve 69 (in dotted lines) is plotted which represents the pressure drop across the sealing means 66 of the well logging tool 60 of the present invention when the selective bypass means 67 is utilized. Actuation point 70 on curve 69 represents a predetermined pressure force corresponding to a particular flow rate, at which point 70 selective bypass means 67 is selectively actuated to direct a portion of the flowing fluid 63 away from housing 64. Selective bypass means 67 thus reduces the net rate of pressure increase across the sealing means 66, and extends the effective operating range of packer flowmeter 60.

As will be hereinafter described, selective bypass means 67 directs a greater portion of the flowing fluid 63 away from housing 64 as the flow rate of the flowing fluid 63 and the pressure forces on sealing means 66 increases. The selective bypass means 67 allows an increased amount of the flowing fluid 63 to be directed away from housing 64 at a known rate. Therefore, the pressure drop across sealing means 66 and the corresponding flow rate of the flowing fluid 63 through well logging tool, or packer flowmeter, 60 may be accurately correlated with the actual flow rate of the flowing fluid 63 in the well casing 62. In general, the extended operating range of well logging tool, or packer flowmeter, 60 is represented by that portion 69' of curve 69 in FIG. 2, beginning to the right of the predetermined actuation point 70, at 70', and extending to the right, and corresponding to increased flow rates. Portion 69' of curve 69 thus represents the increase in measurable flow rate, or extended operating range, of well logging tool 60 without encountering an excessive pressure drop across the packer, or sealing means 66.

Figure 3C:
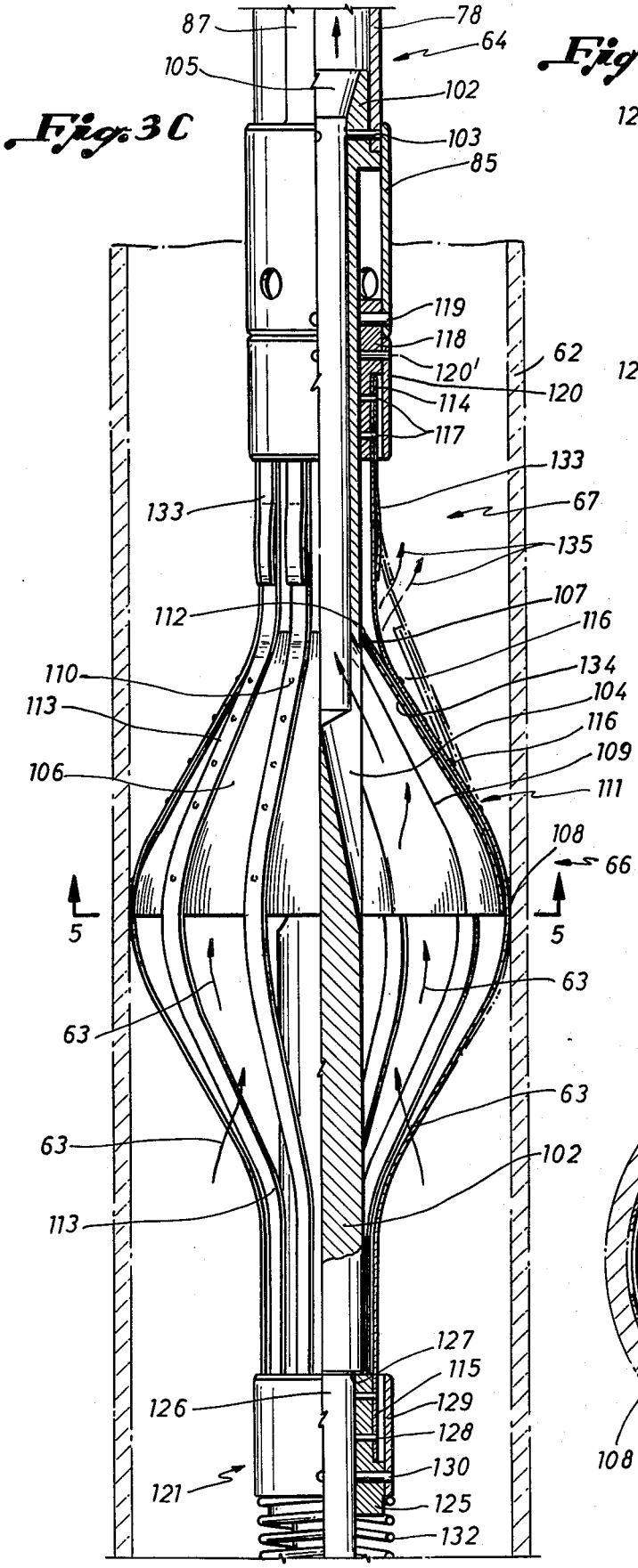

Turning now to FIGS. 3A-3D, the structure of the well logging tool, or packer flowmeter, 60 in accordance with the present invention will be described in greater detail. For ease of understanding and drawing clarity, packer flowmeter 60 has been divided into four figures, FIGS. 3A-3D. With reference to FIG. 1, FIG. 3A generally corresponds to that portion of packer flowmeter 60 disposed above line 71; FIG. 3B generally corresponds to that portion of packer flowmeter disposed between lines 71 and 72; FIG. 3C generaly corresponds to that portion of packer flowmeter 60 disposed between lines 72 and 73; and FIG. 3D generally corresponds to that portion of packer flowmeter 60 disposed below line 73 in FIG. 1. In general, as seen in FIGS. 3A-3C, housing 64 comprises a plurality of generally tubular shaped sections 74, 75, 76, 77 and 78, which are interconnected to one another as by any suitable connections, such as bolts 79 (FIG. 3A) and threaded connections 80 (FIG. 3B). An actuator sleeve 81 (FIG. 4) is slideably mounted about the housing. With reference to FIG. 4, it is seen that actuator sleeve 81 is a generally tubular shaped, elongate member having a plurality of openings 82 formed in its circumference which leave three annular collars 83, 84, and 85 interconnected to one another by webs 86 and 87. Annular collar 83 is shown in FIG. 3A, annular collar 84 is shown in FIG. 3B, and annular collar 85 is shown in FIG. 3C. It should be noted that although housing 64 and actuator sleeve 81 have generally tubular cross-sectional configurations, it will be readily apparent to one of ordinary skill in the art that other cross-sectional configurations could be utilized, so long as actuator sleeve 81 and housing 64 have the same cross-sectional configuration.

With reference to FIG. 3A, it is seen that contained within tubular housing member 74 is an actuator member 88 which is operatively associated with annular collar 83 of actuator sleeve 81 as by bolt 89. Bolt 89 engages opening 90 (FIG. 4) in annular collar 83. Any conventional power source may be utilized to move actuator member 88, which in turn provides longitudinal movement of actuator sleeve 81 with respect to housing 64. Tubular housing member 74 has a slot 93 formed therein through which bolt 89 may pass upon actuation of actuator member 88. The packer flowmeter 60 of the present invention may be suspended within well casing 62 by a wireline, or well-logging cable (not shown) as is well known in the art.

With reference to FIG. 3B, the means for measuring 65 a fluid characteristic of the flowing fluid 63 will be described in greater detail. In the preferred embodiment, the means for measuring 65 is a flowmeter for measuring the flow rate of fluid 63. It should be understood that measuring means 65 could be any device for measuring other fluid characteristics, such as the percentage composition of the fluid 63, salinity, etc. As shown in FIG. 3B, it is seen that the means for measuring 65, or flowmeter spinner 97 is mounted within housing 64. Spinner 97 is rotatably mounted upon a spinner cone 98, which in turn is connected to a suitable housing 99. Conventional electrical devices, such as indicated at 100 and 100' are operatively associated with spinner 97. Upon flowing fluid entering housing 64, as shown by arrow 63, and impinging upon spinner 97 the rotational movement thus imparted to spinner 97 is converted into conventional electrical signals which can be converted into the flow rate of the flowing fluid 63. It should be noted that suitable electrical connections and conductors (not shown) pass through housing 64 to the wireline or well-logging cable as is well known in the art. It should also be noted that any other suitable device may be utilized within housing 64 to measure the flow rate or other fluid characteristics of the flowing fluid. Still with reference to FIG. 3B, it is seen that housing 64 is provided with at least one, and preferably a plurality of slot-like openings 101 through which the flowing fluid 63 may exit the housing 64 of well logging tool, or packer flowmeter, 60 after the flowing fluid 63 has passed spinner 97. The openings 101 are in a mating relationship with openings 82 in actuator sleeve 81, as seen with reference to FIGS. 3B and 4.

With reference now to FIG. 3C, the means for sealing 66 the well borehole 61, or casing 62 and the selective bypass means 67 will be described in greater detail. It is seen that housing 64 includes a mandrel 102 secured to the lower end of tubular housing member 78 as by bolts 103. Mandrel 102 has at least one passageway 104 in fluid transmitting relationship between the sealing and directing means 66 and the measuring means 65, which is disposed upstream of the upper end 105 of mandrel 102. As seen in FIG. 3C, annular collar 85 of actuator sleeve 81 is in sliding engagement with mandrel 102 and tubular housing member 78 of housing 64, as will be hereinafter described in greater detail. The means for sealing and for directing 66 the flowing fluid 63 into housing 64 is shown to comprise in FIGS. 3C and 5 a plurality of flexible vanes 106 having upper, lower, and side edges 107-109. The side edges 109 of flexible vanes 106 are disposed in an overlapping relationship, as shown at 110 in FIG. 5, so that together the vanes 106 form a downwardly flared funnel shaped basket 111 which serves to direct the flowing fluid 63, as shown by arrows 63, into passageway 104 of mandrel 102. The lower edges 108 of vanes 106 are disposed adjacent to the interior surface of well casing 62, and the upper edges 107 of vanes 106 are normally disposed in a first position in an abutting relationship with the housing 64, or mandrel 102, as is shown at 112 in FIGS. 3C and FIG. 5. If well logging tool is to be used in an open borehole 61 the lower edges 108 of vanes 106 will be disposed adjacent to the interior surface of well bore 61.

Figure 5:
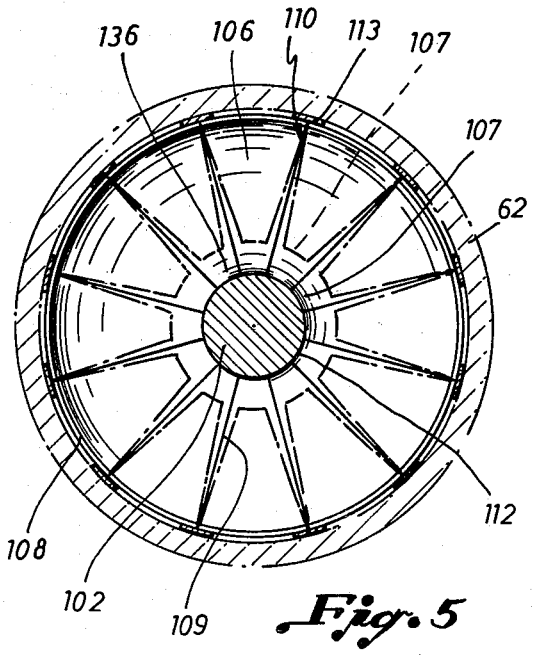
FIG. 5 is a partial cross-sectional view taken along line 5—5 of FIG. 3C.

Still with reference to FIG. 3C, the selective bypass means 67 will be described in greater detail. Selective bypass means 67 preferably comprises a plurality of elongate spring members 113, each having first and second ends 114 and 115, the first ends 114 being operatively associated with the housing 64. The vanes 106, being preferably made of a suitable thin metal, are flexibly secured to the elongate spring members 113 via a plurality of rivets 116, or any other suitable connectors. The flexible connection is caused by the fact that the vanes 106 are quire thin, and because rivets 116 are spaced inwardly from the first and second ends 114 and 115 of elongate spring members 113. The vanes 106 have a generally wedge-shaped configuration with the upper edge 107 being slightly curved as shown in FIG. 5 so that it closely conforms to the outer surface of housing 64, or mandrel 102, when it is in its abutting relationship as shown at 112 with mandrel 102.

Still referring to FIG. 3C, it is seen that the first ends 114 of elongate spring members 113 are operatively associated with housing 64 by means of a plurality of bolts 117, or any other suitable connectors, which secure the first ends 114 of elongate spring members 113 to a tubular ring member 118 which is slideably mounted around mandrel 102. Ring member 118 is in turn connected to annular collar 85 of actuator sleeve 81 by a plurality of bolts 119, or any other suitable connectors. Thus, upon longitudinal movement of actuator sleeve 81 with respect to housing 64, ring member 118 and the first ends 114 of elongate spring members 113 are likewise moved longitudinally. Ring member 118 may, if desired, be provided with an annular cover member 120 which overlies the first ends 114 of elongate spring members 113 and is secured to ring member 118 by a plurality of bolts 120', or any other suitable connector.

Figure 3D:
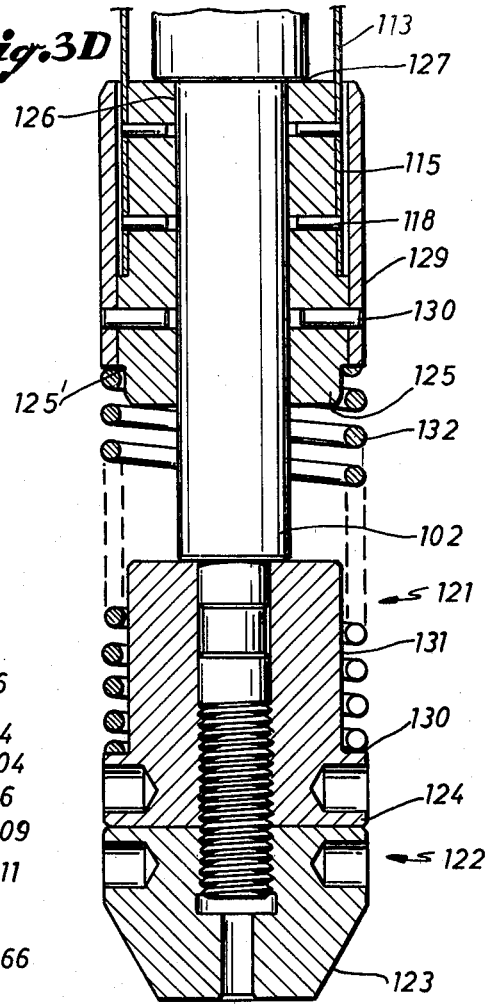

With reference to FIGS. 3C and 3D, it is seen that the second ends 115 of elongate spring members 113 are mounted to a bottom nose assembly, generally indicated at 121, for relative longitudinal movement between bottom nose assembly 121 and the second ends 115 of elongate spring members 113. Bottom nose assembly 121 includes a nose, or end, section 122 comprised of two generally cylindrical sections 123 and 124 which are threadedly secured to the end of mandrel 102. Bottom nose assembly 121 also includes a tubular spring mounting member 125 which is sideably mounted upon the end of mandrel 102. The end of mandrel 102 has a reduced diameter portion 126 which provides a shoulder 127 which precludes further upward movement of tubular spring mounting member 125. The second ends 115 of elongate spring members 113 are secured to tubular spring mounting member 125 via a pluralityof bolts 128, or any other suitable connectors. Tubular spring mounting member 125 may also be provided with a tubular cover member 129 which overlies the second ends 115 of elongate spring members 113, the cover member 129 being secured to tubular spring mounting member 125 by a plurality of bolts 130, or any other suitable connectors. Cylindrical section 124 of nose section 122 is provided with an annular shoulder 130 and a reduced diameter portion 131. Disposed between nose section 122 and tubular spring mounting member 125 is a coil spring 132. Spring 132 surrounds reduced diameter portion 131 and abuts shoulder 130 on cylindrical section 124 at its lower end, and at its upper end abuts a shoulder 125', formed on spring mounting member 125 and the lower end of cover member 129. Spring 132, as will be hereinafter described in greater detail, serves to bias spring mounting member 125 and the second ends 115 of elongate spring members 113 in an upward direction toward the vanes 106 of sealing means 66.

Referring to FIG. 3C, further details of selective bypass means 67 will be described. Selective bypass means 67 may also include a plurality of elongate booster spring members 133, or lead springs, which are operatively associated with the housing 64. Booster springs 133 overlie the elongate spring members 113, and in the preferred embodiment overlie the first ends 114 of elongate spring members 113. Preferably, booster springs 133 are secured to ring member 118 by the same bolts 117 which secure the first ends 114 of elongate spring members 113 to ring member 118. As shown in solid lines in FIG. 3C, booster springs 133 are slightly curved and serve to bias the first ends 114 of elongate spring members 113 inwardly toward mandrel 102. Sealing and directing means 66 may also include a plurality of back-up spring members 134 which are secured to the underside of vanes 106, and are preferably secured in place by the same rivets 116, or other suitable connectors, which secure vanes 106 to elongate spring members 113. The flexible vanes 106 are attached to elongate spring members 13 intermediate the first and second ends 114 and 115 of elongate sprig members 113, and are disposed between the elongate spring members 113 and back-up springs 134.

With reference now to FIGS. 2, 3C, and 5, the operation of the well logging tool, or packer flowmeter, 60 of the present invention will be described. In FIG. 3C the position of the upper edges 107 of vanes 106 are in an abutting relationship 112 with the housing 64, or mandrel 102, as shown in solid lines. This first position corresponds to the use of the packer flowmeter 60 when the flow rate of the flowing fluid 63 and corresponding pressure drop across sealing and directing means 66, corresponds to that portion of the curve 68 in FIG. 2 disposed between a zero flow rate and actuation point 70. Actuation point 70, corresponds to a predetermined pressure force exerted by the flowing fluid 63 upon sealing and directing means 66. The actuation point 70 is selected in accordance with the size of packer flowmeter 60 and expected flow conditions in well casing 62. It should be noted that elongate spring members 113, booster springs 133, and back-up springs 134, each have a particular spring constant associated therewith, which serve to exert a force upon vanes 106 and bias the upper edges 107 of vanes 106 toward housing 64, or mandrel 102, as shown in FIGS. 3C and 5. When the flow rate of the flowing fluid 63, and its resultant pressure force exerted upon sealing and directing means 66 exceed the predetermined pressure force represented by actuation point 70 in FIG. 2, the resulting pressure force will exceed the spring biasing forces of elongate spring members 113, booster springs 133, and back-up springs 134. Then, at least one, and preferably all, of the upper edges 107 of the vanes 106 will assume a second position, as shown in dotted line in FIGS. 3C and 5, spaced from the housing 64, or mandrel 102. As shown by dotted arrows 135 in FIG. 3C, a portion of the flowing fluid 63 will be directed away from housing 64, or mandrel 102, through the annular space 136 (FIG. 5) disposed between mandrel 102 and the upper edges 107 of vanes 106. As the flow rate through well casing 62 increases, including a corresponding increased pressure force exerted upon sealing means 66 (as illustrated by that portion of curve 69 to the right of actuation point 70), the size of annular space 136 will increase to allow a greater portion of the flowing fluid 63 to be directed away from housing 64. Likewise, as the flow rate and pressure forces decrease, selective bypass means 67, or the forces exerted upon vanes 106 by the elongate spring members 113 and booster springs 133, will cause the upper edges 107 of vanes 106 to move toward housing 64, or mandrel 102, to decrease the size of annular space 136.

When it is desired to move the well logging tool, or packer flowmeter, 60 of the present invention into the well casing 62, actuator member 88 is moved and the actuator sleeve 81, which is operatively associated therewith, are moved upwardly with respect to housing 64. As seen in FIG. 3C, when actuator sleeve 81 is moved upwardly, its connection to ring member 118 will thus exert a force to pull upwardly on elongate spring members 113. That force and movement causes the cross-sectional diameter of the basket 111 to be contracted, whereby the packer flowmeter 60 may be readily moved through well casing 62 to a location whereat flow rate measurements, or other measurements of fluid characteristics, are desired to be taken. In that regard, it should be pointed out that the shoulder 127 of mandrel 102 precludes any additional upward sliding movement of the bottom nose assembly 121, and thus allows the cross-sectional diameter of basket 111 to be reduced. Upon the packer flowmeter 60 being lowered via a well-logging cable to the desired location whereat fluid flow rates are desired to be measured, actuator member 88 is moved downwardly with respect to housing 64. This in turn causes downward movement of actuator sleeve 81. As actuator sleeve 81 is moved downwardly with respect to housing 64, the elongate spring members 113 are also moved downwardly and the cross-sectional diameter of the basket 111 expands until the lower edges 108 of the vanes 106 are disposed adjacent the interior surface of well casing 62 in a sealing relationship. That sealing relationship is further enhanced by the biasing force of spring 132 on bottom nose assembly 121 which also biases elongate spring members 113 and the lower edges 108 of vanes 106 into an abutting, sealing relationship to the well casing 62.

It is to be understood that the invention is not limited to the exact details of construction, operation, exact materials, or embodiment shown and described, as obvious modifications and equivalents will be apparent to one skilled in the art; for example, the sealing and directing means could be one integral, funnel-shaped metal basket having a plurality of pleats to provide the requisite flexibility so that the upper edge of the basket could move away from the mandrel upon encountering increased pressure forces over the basket surface. Accordingly, the invention is therefore to be limited only by the scope of the appended claims.

We claim:

1. A well-logging tool, for use within a well borehole for measuring a characteristic of a flowing fluid therein, comprising:

a housing;

means for measuring a characteristic of the flowing fluid, the means for measuring being disposed within the housing;

means for sealing the annulus between the well borehole and the housing and for directing the flowing fluid into the housing; and selective bypass means for directing a portion of the flowing fluid prevented by said sealing and directing means from flowing through said annulus, to bypass the housing upon the flowing fluid exerting a predetermined pressure force upon the sealing and directing means, whereby damage to the sealing and directing means from increased pressure forces is minimized and fluid characteristics of fluids having widely varying flow rates may be measured.

2. The well logging tool of claim 1, wherein the means for sealing and directing comprises a plurality of flexible vanes having upper, lower, and side edges, with the side edges of adjacent vanes being disposed in an overlapping relationship; the lower edges of the vanes being disposed adjacent to the interior surface of the well borehole; the upper edges of the vanes being disposed in a first position in an abutting relationship with the housing when the pressure force is below the predetermined force; and at least one of the upper edges of the vanes being disposed in a second position spaced from the housing when the pressure force exceeds the predetermined force.

3. The well logging tool of claim 2, wherein the selective bypass means comprises a plurality of elongate spring members each having first and second ends, the first ends being operatively associated with the housing; and the vanes being flexibly attached to the elongate spring members.

4. The well logging tool of claim 3, wherein each of the second ends of the elongate spring members are mounted to a bottom nose assembly for relative longitudinal movement therebetween; and the flexible vanes are flexibly attached to the elongate spring members intermediate their first and second ends.

5. The well logging tool of claim 4, wherein the housing includes a mandrel secured thereto; the mandrel having at least one passageway in fluid transmitting relationship between the seling and directing means, and the means for measuring; the first ends of the elongate spring members being slidably mounted with respect to the mandrel; and a first portion of the bottom nose assembly is slidably mounted to the mandrel.

6. The well logging tool of claim 5, wherein a second portion of the bottom nose assembly is secured to the mandrel, and the first portion of the bottom nose assembly is resiliently biased toward the vanes.

7. The well logging tool of claim 3, wherein the selective bypass means further includes a plurality of elongate booster spring members which are operatively associated with the housing and which overlie the elongate spring members.

8. The well logging tool of claim 3, further including a plurality of back-up spring members attached to the flexible vanes, the vanes being disposed between the elongate and back-up spring members.

9. The well-logging tool of claim 3, further including an actuator sleeve slidably mounted about the housing, the actuator sleeve being operatively associated with the first ends of the elongate spring members, whereby upon movement of the actuator sleeve in a first direction, the lower edges of the vanes are moved adjacent the interior surface of the well casing, and upon movement of the vanes in a second direction, the lower edges of the vanes are moved away from the interior surface of the well casing to allow the well logging tool to be removed from the well casing.

10. The well-logging tool of claim 9, wherein the actuator sleeve has at least one opening to allow fluid to flow out the housing into the well casing.

11. The well-logging tool of claim 1, wherein the means for measuring is a flowmeter.

12. A method for measuring fluid characteristics of a fluid flowing at varying flow rates within a well borehole, comprising:

moving a housing, having a means for measuring the fluid characteristics disposed within the housing, through the well borehole to a first location:

sealing the annulus between the well borehole and the housing proximate the first location and directing the flowing fluid into the housing by utilizing a sealing and directing means; and directing a portion of the flowing fluid prevented by said sealing and directing means from flowing through the annulus, to bypass the housing upon the flowing fluid exerting a predetermined pressure force upon the sealing and directing means, whereby damage to the sealing and directing means from increased pressure forces is minimized and fluid characteristics of fluids flowing at varying flow rates may be measured.

13. The method of claim 12, including the steps of: utiliziing a sealing and directing means having a plurality of flexible vanes having upper and lower edges; disposing the lower edges of the vanes adjacent the interior surface of the well borehole; disposing the upper edges of the vanes in a first position in an abutting relationship with the housing when the pressure force is below the predetermined force; and disposing at least one of the upper edges of the vanes in a second position spaced from the housing when the pressure force exceeds the predetermined force.

14. The method of claim 13 including the steps of flexibly attaching the plurality of flexible vanes to a plurality of elongate spring members having first and second ends, and operatively associating the first ends with the housing.

15. The method claim 14, including the steps of mounting the second ends of the elongate spring members to a bottom nose assembly for relative longitudinal movement therebetween; and flexibly attaching the flexible vanes to the elongate spring members intermediate their first and second ends.

16. The method of claim 15 including the steps of: utilizing a mandrel secured to the housing; slidably mounting the first ends of the elongate spring members with respect to the mandrel; and slidably mounting a first portion of the bottom nose assembly to the mandrel.

17. The method of claim 16 including the steps of securing a second portion of the bottom nose assembly to the mandrel, and resiliently biasing the first portion of the bottom nose assembly toward the vanes.

18. The method of claim 14 including the steps of utilizing a plurality of elongate booster spring members, and disposing the booster spring members to overlie the elongate spring members.

19. The method of claim 14 further including the steps of: utilizing a plurality of back-up spring members; attaching the backup spring members to the flexible vanes; and disposing the vanes between the elongate and back-up spring members.

20. The method of claim 14 further including the steps of: slidably mounting an actuator sleeve about the housing; operatively associating the actuator sleeve with the first ends of the elongate spring members; moving the actuator sleeve in a first direction to move the lower edges of the vanes adjacent the interior surface of the well casing; and moving the actuator sleeve in a second direction to move the lower edges of the vanes away from the interior surface of the well borehole to allow the housing to be moved to a second location.

21. The method of claim 20 including the step of providing the actuator sleeve with at least one opening to allow fluid to flow out the housing into the well casing.

22. A well-logging tool for measuring the flow rate of a fluid flowing within a well borehole, comprising:

a housing, a flowmeter disposed within the housing, means for sealing the annulus between the borehole and the housing and for directing the flowing fluid into the housing, selective bypass means for directing a portion of the flowing fluid prevented by said sealing and directing means from flowing through the annulus, to bypass the housing, upon a predetermined pressure force, resulting from a predetermined flow rate, being exerted on said sealing and directing means, said portion increasing at a known rate as the flow rate increases.

23. A method for measuring the flow rate of a fluid flowing within a well borehole, comprising:

moving a housing having a flowmeter disposed therein through the borehole to a first location, sealing the annulus between the housing and the wall of the borehole and directing the flowing fluid into the housing, by utilizing sealing and directing means, directing a portion of the flowing fluid prevented by said sealing and directing means from flowing through said annulus, to bypass the housing, upon a predetermined pressure force, resulting from a predetermined flow rate, being exerted on the sealing and directing means by the flowing fluid, said portion increasing at a known rate as the flow rate increases, measuring the flow rate within the housing by means of said flowmeter, the actual flow rate in the borehole being determinable from said measurement.

* * * * *